US007594881B2

(12) United States Patent
Shifferaw

(10) Patent No.: US 7,594,881 B2
(45) Date of Patent: Sep. 29, 2009

(54) COMPACT WEIGHT BENCH

(76) Inventor: Tessema Dosho Shifferaw, 1019 Solano Ave., Albany, CA (US) 94706

( * ) Notice: Subject to any disclaimer, the term of this patent is extended or adjusted under 35 U.S.C. 154(b) by 828 days.

(21) Appl. No.: 10/854,953

(22) Filed: May 26, 2004

(65) Prior Publication Data

US 2005/0266972 A1 Dec. 1, 2005

(51) Int. Cl.
*A63B 21/072* (2006.01)

(52) U.S. Cl. ..... 482/142; 482/108; 482/137

(58) Field of Classification Search ..... 482/44, 482/79, 80, 92, 93, 97, 98, 104, 106–109, 482/137, 138, 142, 145, 146; D21/675, 676
See application file for complete search history.

(56) References Cited

U.S. PATENT DOCUMENTS

| | | | | | |
|---|---|---|---|---|---|
| 4,183,520 | A | * | 1/1980 | Chase | 482/112 |
| 4,448,412 | A | * | 5/1984 | Brentham | 482/112 |
| 4,509,746 | A | * | 4/1985 | Mask | 482/137 |
| 4,546,968 | A | * | 10/1985 | Silberman | 482/97 |
| 4,566,691 | A | * | 1/1986 | Mahnke | 482/104 |
| 4,598,908 | A | * | 7/1986 | Morgan | 482/138 |
| 4,634,127 | A | * | 1/1987 | Rockwell | 482/138 |
| 4,641,833 | A | * | 2/1987 | Trethewey | 482/95 |
| 4,667,955 | A | * | 5/1987 | Giesch | 482/113 |
| 4,799,670 | A | * | 1/1989 | Williamson | 482/97 |
| D301,597 | S | * | 6/1989 | Lehtonen | D21/675 |
| 4,861,025 | A | * | 8/1989 | Rockwell | 482/142 |
| D303,558 | S | * | 9/1989 | Alessandri | D21/675 |
| 4,883,269 | A | * | 11/1989 | Shaver | 482/97 |
| 4,949,958 | A | * | 8/1990 | Richey | 482/96 |
| 5,069,447 | A | * | 12/1991 | Snyderman et al. | 482/133 |
| 5,769,762 | A | | 6/1998 | Towley, III et al. | |
| 6,482,139 | B1 | * | 11/2002 | Haag | 482/121 |
| 6,595,905 | B2 | * | 7/2003 | McBride | 482/130 |
| 6,905,446 | B2 | * | 6/2005 | Greenland | 482/100 |
| 2002/0119872 | A1 | * | 8/2002 | Greenheck | 482/93 |
| 2004/0033871 | A1 | * | 2/2004 | Ma | 482/142 |
| 2005/0049121 | A1 | | 3/2005 | Dalebout | |

FOREIGN PATENT DOCUMENTS

| | | | | |
|---|---|---|---|---|
| CA | 2438944 | A1 | * | 3/2004 |
| DE | 29813640 | U1 | * | 12/1999 |
| DE | 20107535 | U1 | * | 8/2001 |
| FR | 2627090 | A1 | * | 8/1989 |
| GB | 2065482 | A | * | 7/1981 |
| GB | 2232089 | A | * | 12/1990 |

* cited by examiner

*Primary Examiner*—Loan H Thanh
*Assistant Examiner*—Victor K Hwang
(74) *Attorney, Agent, or Firm*—Edward S. Wright

(57) ABSTRACT

Weight bench having a horizontally extending seat, an upstanding post at one end of the seat, a swinging arm pivotally connected to the upper portion of the post for movement between raised and lowered positions, a pair of leg rests extending laterally from the upper portion of the post, a weight bar extending laterally from a free end of the swinging arm, a plurality of weights interchangeably mounted on the weight bar, pads on the weight bar for engagement by the legs of a person doing leg exercises, and a handle attached to the swinging arm for engagement by the hands of a person sitting on the seat for doing upper body and arm exercises.

17 Claims, 1 Drawing Sheet

COMPACT WEIGHT BENCH

BACKGROUND OF THE INVENTION

1. Field of Invention

This invention pertains generally to exercise and fitness equipment and, more particularly, to a compact weight bench for use in doing upper body and arm exercises as well as leg exercises.

2. Related Art

Exercise machines of the type commonly known as weight benches have been heretofore been provided for exercising the upper body and arms and/or the legs. Such machines tend to be somewhat complex and bulky because they generally have separate bars and weights for the upper body and arms and for the legs.

OBJECTS AND SUMMARY OF THE INVENTION

It is, in general, an object of the invention to provide a new and improved weight bench.

Another object of the invention is to provide a weight bench of the above character which overcomes the limitations and disadvantages of the prior art.

These and other objects are achieved in accordance with the invention by providing a weight bench having a horizontally extending seat, an upstanding post at one end of the seat, a swinging arm pivotally connected to the upper portion of the post for movement between raised and lowered positions, a pair of leg rests extending laterally from the upper portion of the post, a weight bar extending laterally from a free end of the swinging arm, a plurality of weights interchangeably mounted on the weight bar, pads on the weight bar for engagement by the legs of a person doing leg exercises, and a handle attached to the swinging arm for engagement by the hands of a person sitting on the seat for doing upper body and arm exercises.

DETAILED DESCRIPTION

Figure 1:
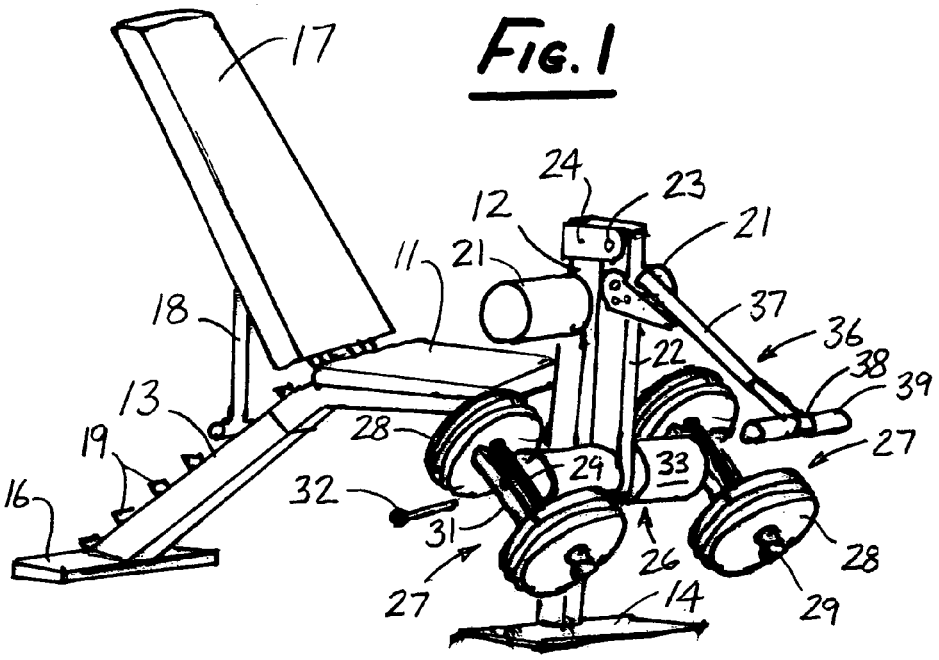
FIG. 1 is an isometric view of one embodiment of a weight bench incorporating the invention.
Figure 2:
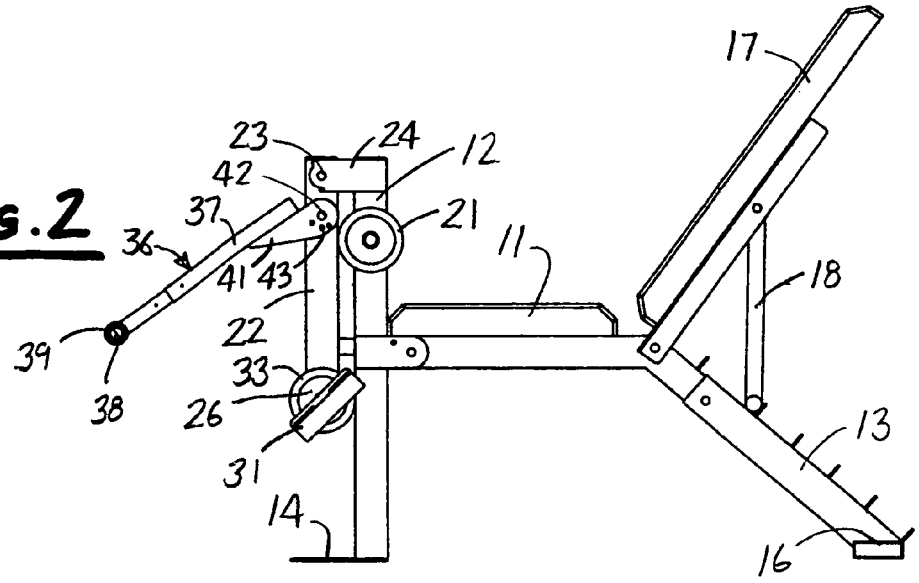
FIG. 2 is a side elevational view of the embodiment of FIG. 1, with the dumbbells removed.
Figure 3:
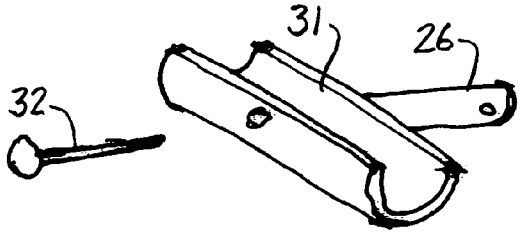
FIG. 3 is an isometric view of one of the dumbbell holders in the embodiment of FIG. 1.

As illustrated in FIG. 1, the machine has a horizontally extending seat 11 which is supported at one end by an upstanding post 12 and at the other by a rearwardly inclined leg 13. The post and leg have laterally extending, generally rectangular foot plates 14, 16 which rest upon the floor.

A back rest 17 is hingedly connected at the rear of the seat, with a support arm or brace 18 extending between the back rest and rear leg 13 for holding the back rest at different angles relative to the seat. The upper end of the brace is pivotally connected to the back rest, and the lower end rests on flanges 19 on the upper side of the leg.

The post extends higher than the seat, and a pair of cushioned leg rests 21 extend laterally from the upper portion of the post. A weight support arm 22 is pivotally connected to the upper portion of the post for swinging movement between raised and lowered positions on the front side of the post. In the embodiment illustrated, the pivot is formed by a pin or bolt 23 which extends between a pair of flanges 24 on the post end passes through the arm.

A weight bar 26 extends laterally from the free end of the arm, with weights 27 mounted on the outer ends of the bar. In the embodiment illustrated, the weights consist of dumbbells having a plurality of interchangeable weight plates 28 mounted on bars 29 which are received in weight holders 31 on the ends of the bars. The weight holders are in the form of semicylindrical cups, and the bars are retained in the cups by pins 32. The cups face in an upward direction, and hold the bars of the dumbbells at an angle of about 45° relative to the swing arm.

Leg pads 33 in the form of cushions or rollers are mounted on the weight bar between arm 22 and the weight holders for engagement by the legs of a person sitting on seat 11 or standing on foot plate 14.

A handle 36 is attached to weight arm 22 so that the weights mounted on the arm can be lifted by the upper body and arms of a person sitting on the seat as well as by his legs. The handle is T-shaped, with a stem 37 that is attached to the weight arm and a crossbar 38 with grips 39 that can be grasped by the hands of the exerciser. The handle is pivotally attached to the arm for movement between an operative position in which the stem extends from the arm at an angle of about 90° and a storage position in which the stem is next to the arm. The handle is connected to the arm by a clevis 41 at the base of the stem and a bolt or pin 42 which passes through the clevis and the arm, with a pin 43 for securing the handle in its two positions.

For upper body and arm exercises, a person sits on the bench facing the post, gripping the handle with his hands. When the arm and weights are in the down position, the handle extends in a generally horizontal direction, and the person lifts the weights by pulling the handle toward himself. If he wants, he can lift the weights through almost 180° of handle motion because the weights will travel in an upward direction until the handle reaches the back rest in its horizontal position.

For leg extensions, the handle is locked in its down position, and the person sits on the bench with his legs extending over leg rests 21 and behind the leg pads 33 on the weight bar. He then works his legs by lifting them against the force of the weights.

For leg curls, the person stands on foot plate 14, facing the bench, with the handle in its down position, and the backs of his calves against the leg pads on the weight bar. He then works his legs by bending them at the knee to lift the weights.

The invention has a number of important features and advantages. It uses the same weights for upper body and arm exercises as well as leg exercises, and it is therefore relatively inexpensive and compact. The weights are mounted in a manner which makes them easy to change, and the dumbbells which are used as weights can be removed and used as free weights, if desired.

It is apparent from the foregoing that a new and improved weight bench has been provided. While only one presently preferred embodiment has been described in detail, as will be apparent to those familiar with the art, certain changes and modifications can be made without departing from the scope of the invention as defined by the following claims.

The invention claimed is:

1. A weight bench comprising a horizontally extending seat, an upstanding post at one end of the seat, a swinging arm pivotally connected to the upper portion of the post for movement between raised and lowered positions, a pair of leg rests extending laterally from the upper portion of the post, a weight bar extending laterally from a free end of the swinging arm, dumbbells having weight plates interchangeably mounted on bars toward the outer ends of the weight bar, with the bars of the dumbbells inclined at an angle on the order of 45° relative to the swinging arm, pads on the weight bar between the swinging arm and the dumbbells for engagement by the legs of a person doing leg exercises, and a handle attached to the swinging arm for engagement by the hands of a person sitting on the seat for doing upper body and arm exercises.

2. The weight bench of claim 1 wherein the handle extends from the swinging arm at an angle on the order of 90°.

3. The weight bench of claim 2 wherein the handle is generally T-shaped and has a crossbar with grips engagable by the hands.

4. The weight bench of claim 1 wherein the handle is pivotally connected to the swinging arm and can be rotated to a position adjacent to the arm for storage.

5. The weight bench of claim 1 wherein the dumbbells are removably mounted in holders on the weight bar.

6. The weight bench of claim 5 wherein the weight holders have semicylindrical cups for receiving the bars of the dumbbells and pins for retaining the bars in the cups.

7. A weight bench comprising a horizontally extending seat, a swinging arm toward one end of the seat, a weight bar extending laterally from the swinging arm for engagement by the legs of a person doing a leg exercise, weight holders affixed to the outer ends of the weight bar, dumbbells having weight plates interchangeably mounted on bars which rest in the weight holders and extend in a direction perpendicular to the weight bar, and a handle attached to the swinging arm for engagement by the hands of a person doing an upper body or arm exercise.

8. The weight bench of claim 7 wherein the bars of the dumbbells are inclined at an angle on the order of 45° relative to the swinging arm.

9. A weight bench comprising a horizontal seat extending between an upstanding front post and a rearwardly inclined rear leg, a back rest hingedly connected to the seat, a support extending between the back rest and the rear leg for holding the back rest at different angles relative to the seat, a swinging arm pivotally connected to the upper portion of the post for movement between raised and lowered positions, a pair of leg rests extending laterally from the upper portion of the post, a weight bar extending laterally from a free end of the swinging arm, dumbbells having weight plates interchangeably mounted on bars toward the outer ends of the weight bar, with the bars of the dumbbells inclined at an angle on the order of 45° relative to the swinging arm, pads on the weight bar between the swinging arm and the dumbbells for engagement by the legs of a person doing leg exercises, and a generally T-shaped handle having a stem which extends from the swinging arm at an angle on the order of 90° and a cross bar adapted to be grasped by the hands of a person sitting on the seat for doing upper body and arm exercises.

10. The weight bench of claim 9 wherein the handle is pivotally attached to the swinging arm and can be rotated to a position adjacent to the arm for storage.

11. The weight bench of claim 9 wherein the dumbbells are removably mounted in holders toward the outer ends of the weight bar.

12. The weight bench of claim 11 wherein the weight holders have semicylindrical cups for receiving the bars of the dumbbells and pins for retaining the bars in the cups.

13. A weight bench comprising a horizontally extending seat, an upstanding post at one end of the seat, a swinging arm pivotally connected to the upper portion of the post for movement between raised and lowered positions, a pair of leg rests extending laterally from the upper portion of the post, a weight bar extending laterally from a free end of the swinging arm, weight holders affixed to the outer ends of the weight bar, dumbbells having weight plates interchangeably mounted on bars that rest in the weight holders and extend in a direction perpendicular to the weight bar, means retaining the dumbbells in the weight holders, pads on the weight bar for engagement by the legs of a person doing leg exercises, and a handle attached to the swinging arm for engagement by the hands of a person sitting on the seat for doing upper body and arm exercises.

14. The weight bench of claim 13 wherein the handle has a stem which extends from the swinging arm at an angle on the order of 90° and a cross bar adapted to be grasped by the hands of a person sitting on the seat.

15. The weight bench of claim 13 wherein the bars of the dumbbells are inclined at an angle on the order of 45° relative to the swinging arm.

16. The weight bench of claim 13 including an adjustable back rest at the end of the seat opposite the post.

17. A weight bench comprising a horizontal seat mounted on an upstanding front post and a downwardly and rearwardly inclined rear leg, foot plates at the lower ends of the post and the rear leg, an adjustable back rest to the rear of the seat, a swinging arm pivotally mounted on the post for rotation about an axis directly above the foot plate at the lower end of the post, leg rests extending laterally from opposite sides of the post, a weight bar extending laterally from a free end of the swinging arm, dumbbells having weight plates interchangeably mounted on bars resting in weight holders affixed to opposite ends of the weight bar, pads on the weight bar for engagement by the legs of a person doing leg exercises, and a handle attached lathe swinging arm adapted to be gripped by the hands of a person sitting on the seat for doing upper body and arm exercises.

* * * * *